United States Patent [19]

Ebihara

[11] 4,353,345

[45] Oct. 12, 1982

[54] CARBURETOR

[75] Inventor: Sakae Ebihara, Yokohama, Japan

[73] Assignee: Nissan Motor Company, Ltd., Yokohama, Japan

[21] Appl. No.: 209,188

[22] Filed: Nov. 21, 1980

[30] Foreign Application Priority Data

Nov. 22, 1979 [JP] Japan ..... 54-161095[U]

[51] Int. Cl.[3] ..... F02B 7/00

[52] U.S. Cl. ..... 123/575; 123/525; 261/16; 261/70

[58] Field of Search ..... 123/525, 526, 527, 575, 123/576, 577, 578; 261/16, 70

[56] References Cited

U.S. PATENT DOCUMENTS

| | | | |
|---|---|---|---|
| 2,664,871 | 1/1954 | Anderson | 123/577 |
| 3,223,390 | 12/1965 | Bunze | 123/575 |
| 3,783,841 | 1/1974 | Hirschler, Jr. et al. | 123/576 |
| 3,805,756 | 4/1974 | Madariaga | 123/577 |
| 4,085,720 | 4/1978 | Etoh | 261/18 R |
| 4,129,620 | 12/1978 | Etoh | 261/18 R |

*Primary Examiner*—Charles J. Myhre
*Assistant Examiner*—E. Rollins Cross
*Attorney, Agent, or Firm*—Thompson, Birch, Gauthier & Samuels

[57] ABSTRACT

A carburetor includes means for detecting the volume of a first fuel such as gasoline within a float chamber, and valve means for preventing a second fuel such as LPG from being fed into an induction passage leading to an engine when the volume of the first fuel within the float chamber is above a predetermined value. The second fuel is prevented from being fed into the induction passage until the volume of the first fuel within the float chamber is decreased to a small amount or zero. Thus, the air-fuel mixture within the induction passage is not enriched too much after the fuel supply is changed from the first fuel to the second fuel.

7 Claims, 4 Drawing Figures

CARBURETOR

BACKGROUND OF THE INVENTION

The present invention relates to a carburetor for an internal combustion engine in which two different fuels are selectively used.

In some automotive vehicles, internal combustion engines are designed to use selectively two fuels such as gasoline and LPG according to the operational conditions of the engines. For example, when large outputs from the engines are required, gasoline is used. When fuel costs or consumptions are particularly regarded, LPG is used.

In such type engines, an induction passage is equipped with a carburetor portion for gasoline and a carburetor portion for LPG. A fuel passage leading to the gasoline carburetor portion and a fuel passage leading to the LPG carburetor portion are controlled to be selectively opened or closed so that either of the two fuels can be supplied into the engine.

However, in such type prior art carburetors, a proper air-fuel mixing ratio cannot be easily obtained. Even after the fuel passage leading to the LPG carburetor portion is opened, the gasoline which remains in the float chamber upstream of the fuel regulating valve in the passage leading to the gasoline carburetor portion continues to be supplied into the induction passage leading to the engine. Thus, both gasoline and LPG are fed at the same time so that the air-fuel mixture is enriched too much. As a result, the operability of the engine is decreased. In particular during engine idling, the engine sometimes stops due to such improper air-fuel mixing ratio.

SUMMARY OF THE INVENTION

According to the present invention, a carburetor includes means for detecting the volume of a first fuel such as gasoline within a float chamber, and valve means for preventing a second fuel such as LPG from being fed into an induction passage leading to an engine when the volume of the first fuel within the float chamber is above a predetermined value. The second fuel is prevented from being fed into the induction passage until the volume of the first fuel within the float chamber is decreased to a small amount or zero. Thus, the air-fuel mixture within the induction passage is not enriched too much after the fuel supply is changed from the first to the second fuel.

The object of the present invention is to provide a carburetor in which a good air-fuel mixture ratio can be obtained even after the fuel supply is changed from a first fuel such as gasoline to a second fuel such as LPG.

BRIEF DESCRIPTION OF THE DRAWINGS

These and other objects, features and advantages of the present invention will become more apparent from the following description of several preferred embodiments thereof when read in conjunction with the accompanying drawings in which.

DETAILED DESCRIPTION OF THE PREFERRED EMBODIMENTS

Figure 1:
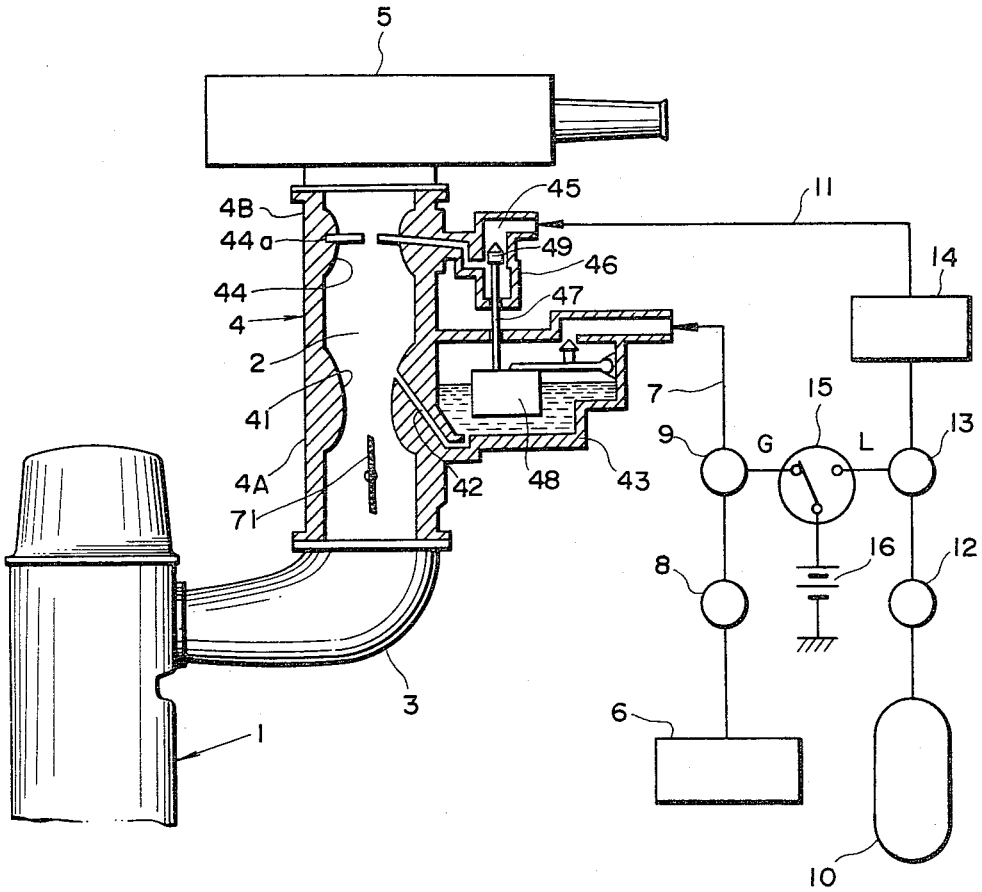
FIG. 1 is a diagramatic view showing a carburetor according to a preferred embodiment of the present invention.

FIG. 1 shows a first embodiment of the present invention. An engine body 1 is connected to an induction passage 2 including an induction manifold 3, a carburetor 4 and an air cleaner 5 in order. The carburetor 4 includes a gasoline carburetor portion 4A and an LPG mixer portion 4B upstream of a throttle valve 71. The gasoline carburetor portion 4A is formed integrally with the LPG mixer portion 4B in the carburetor 4. The gasoline carburetor portion 4A includes a gasoline metering venturi portion 41, a nozzle 42 and a float chamber 43 connected thereto. The LPG mixer portion 4B includes a LPG metering venturi portion 44, a slit nozzle 44a formed on the inner wall thereof and an LPG introducing portion 45.

A gasoline tank 6 is connected with the float chamber 43 by a gasoline feed passage 7 in which a strainer 8 and an electromagnetic fuel pump 9 are arranged.

An LPG container 10 is connected with the LPG introducing portion 45 by an LPG feed passage 11 in which a filter 12, an electromagnetic valve 13 and a vaporizer 14 are provided in order.

The contact G and contact L of a transfer switch 15 are connected to an electric actuating circuit for the electromagnetic fuel pump 9 and an electric actuating circuit for the electromagnetic valve 13, respectively, which in turn are connected to a source, such as a battery 16. When the contact G of the transfer switch 15 is switched on as shown in FIG. 1, the fuel pump 9 is electrically connected with the battery 16 to be actuated to feed gasoline into the float chamber 43, while the electromagnetic valve 13 is closed to shut the LPG feed passage 11. On the contrary, when the contact L of the transfer switch 15 is switched on, the fuel pump 9 stops feeding gasoline, while the electromagnetic valve 13 is opened to feed LPG into the LPG introducing portion 45 of the LPG mixer portion 4B.

The carburetor 4 additionally includes means for controlling the feed of LPG after the LPG feed passage 11 is opened. When the switch 15 is transferred to its contact L, the controlling means prevents LPG from being fed into the induction passage 2 until the gasoline remaining in the float chamber 43 is completely fed into the induction passage 2 due to the venturi vacuum of the carburetor 4.

The controlling means includes a valve casing 46 at the LPG introducing portion 45, a rod 47 vertically extending from the upper side of a float 48 into the valve casing 46, and a needle valve 49 fixed at the upper end of the rod 47. The rod 47 slidably penetrates through an opening of the upper wall of the float chamber 43 and an opening of the bottom wall of the valve casing 46. The needle valve 49 opens or closes the LPG introducing portion 45 in association with the valve casing 46 according to the vertical position of the float 48 within the float chamber 43. For example, when the float 48 moves down to a predetermined level, the needle valve 49 comes automatically into its open position. When there is sufficient gasoline in the float chamber 43, the needle valve 49 is in its closed position to prevent LPG from being fed into the induction passage 2.

According to the first embodiment of the present invention, immediately after the electromagnetic valve 13 is opened and the fuel pump 5 stops, some gasoline remains in the float chamber 43 and continues to be fed into the induction passage 2 due to the venturi vacuum of the carburetor 4. In such a condition, the float 48 is positioned above a predetermined level so that the needle valve 49 is in its closed position, thereby preventing LPG from being fed into the induction passage 2. Thus, only gasoline is fed into the induction passage 2 even after the transfer switch 15 is actuated. As the fuel pump 9 feeds no gasoline, the liquid level of the gasoline in the float chamber 43 moves down together with the float 48 and the rod 47. When the float 48 comes down to a predetermined position, the needle valve 49 opens so that LPG can be fed into the induction passage 2. It is preferable that the needle valve 49 be designed to open when or just before all of the gasoline in the float chamber is fed into the induction passage.

When the needle valve 49 is in its closed position, a very small amount of LPG or substantially no LPG is fed into the induction passage 2. When the needle valve 49 opens, LPG begins to be fed into the induction passage 2, and substantially no gasoline is fed thereinto. Accordingly, when the fuel supply changes from gasoline to LPG, the air-fuel mixture is prevented from being enriched too much so that the engine can continue to operate in a proper condition, even during engine idling.

Figure 2:
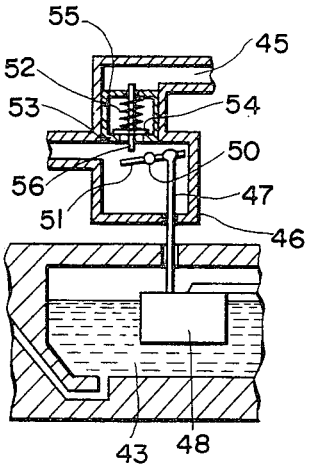
FIG. 2 is a schematic view showing a carburetor according to a further embodiment of the present invention.

FIG. 2 shows a second embodiment of the present invention. The control means includes a rod 47 extending vertically from the upper surface of the float 48 into the valve casing 46 through the openings of the lower wall of the valve casing and the upper wall of the float chamber 43. A lever 51 is rotatably supported at its intermediate portion by a shaft 50. One end of the lever 51 is linked with the upper end of the rod 47. A pin 56 is vertically placed in the LPG introducing portion 45, the lower end of the pin 56 facing the other end of the lever 51, as shown in FIG. 2. The upper end of the pin 56 is fixed through a washer 55 to the inner wall of the LPG introducing portion 45. A coil spring 52 is arranged around the pin 56 and fixed at its upper end to the washer 55. A valve 54 is fixed to the lower end of the spring 52 and pressed against the valve seat 53 under the force of the coil spring 52.

In operation, when the gasoline level drops below a predetermined level, the rod 47 pulls down the right end of the lever 51 so that it rotates clockwise. As a result, the left end of the lever 51 pushes the pin 56 upwardly so that the valve 54 moves up from the valve seat 53. Thus, LPG can be fed into the induction passage 2.

According to the second embodiment of the present invention, until the gasoline level within the float chamber 43 drops to a predetermined position, LPG is prevented from being fed into the induction passage 2 after the electromagnetic valve 13 (FIG. 1) is opened. Therefore, the air-fuel is prevented from being enriched too much, and the engine operation is properly maintained.

Figure 3:
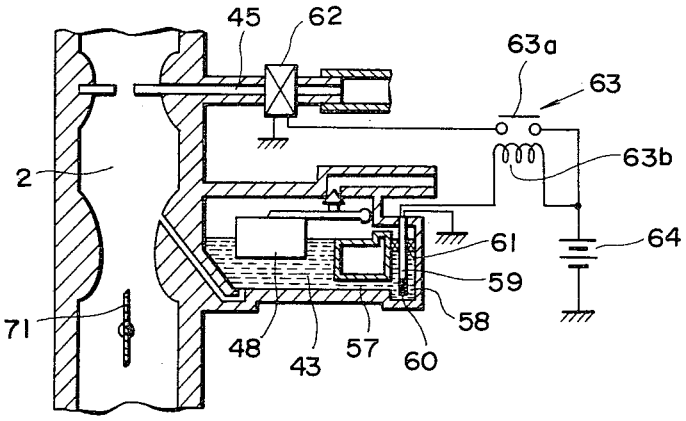
FIG. 3 shows a carburetor according to another embodiment of the present invention.

FIG. 3 shows a third embodiment of the present invention. The position of the float 48 or the liquid level within the float chamber 43 is electrically detected. An auxiliary chamber 58 is formed adjacent the float chamber 43. A connecting passage 57 connects the float chamber 43 with the auxiliary chamber 58 at the bottom thereof. A rod 59 is fixed at its upper end to the auxiliary chamber 58. The rod 59 vertically extends near the bottom of the auxiliary chamber 58 and has a lead switch 60 at its lower end. The lead switch 60 is connected through a coil portion **63*b* of a relay 63 to a battery 64. A float ring 61 having a float and a ring-like magnet attached thereto is slidably positioned around the rod 59 within the auxiliary chamber 58. The float ring 61 floats on the gasoline in the auxiliary chamber 58**.

An electromagnetic valve 62 is provided at the LPG introducing portion 45 to open or close it. An electric circuit for actuating the electromagnetic valve 62 is connected through a contact **63*a* of the relay 63 to the battery 64**.

In operation, when the liquid level within the auxiliary chamber 58 drops to a predetermined position, the magnet on the float ring 61 comes near the lead switch 60 at the lower end of the rod 59 so that the switch 60 can become ON whereby the current flows through the coil portion **63*b* of the relay 63. As a result, the contact 63*a* is closed, and the electromagnetic valve 62 is energized to become open. Thus, LPG begins to be fed into the induction passage 2 from the LPG introducing portion 45**.

According to the third embodiment of the present invention, also, LPG is prevented from being fed into the induction passage 2 until the gasoline level within the float chamber 43 drops to a predetermined position even after the fuel pump 9 (FIG. 1) stops and the electromagnetic valve 13 for shutting the LPG feed passage 11 upstream of the vaporizer 14 (FIG. 1) is opened. Thus, the air-fuel mixture is not enriched too much within the induction passage 2.

Figure 4:
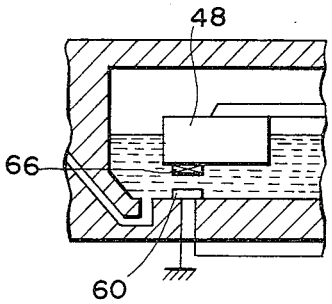
FIG. 4 shows a modification of the embodiment shown in FIG. 3.

FIG. 4 shows a modification of the third embodiment of the present invention shown in FIG. 3. A magnet 66 is attached on the underside of the float 48, and a lead switch 60 is placed on the bottom of the float chamber 43 in a position to face the magnet 66.

Although in the embodiments as above-stated, LPG and gasoline are used as two different fuels, any other combination of two different fuels can be applied to a carburetor including a float chamber placed in at least one fuel feed passage or the like.

The present invention may be practiced or embodied in still other ways without departing from the spirit or essential character thereof. The preferred embodiments described herein are therefore illustrative and not restrictive, the scope of the present invention being indicated by the appended claims and all variations which come within the meaning of the claims are intended to be embraced therein.

What is claimed is:

1. A carburetor for selectively mixing a first fuel and a second fuel with air, comprising:

an induction passage;

first means for mixing the first fuel with air within the induction passage;

second means for mixing the second fuel with air within the induction passage;

a first passage for feeding the first fuel to the first mixing means;

a second passage for feeding the second fuel to the second mixing means;

a float chamber in which the first fuel is held before the first fuel is fed from the first passage into the first mixing means;

a float which floats on the first fuel within the float chamber;

means for detecting the volume of the first fuel within the float chamber; and valve means for closing the second passage when the detecting means detects that the volume of the first fuel within the float chamber is above a predetermined value and for opening the second passage when the detecting means detects that the volume of the first fuel within the float chamber is below the predetermined value.

2. The carburetor of claim 1, wherein the detecting means includes a linkage actuated in response to the vertical movement of the float within the float chamber, and the valve means is actuated by the linkage to be opened or closed.

3. The carburetor of claim 1, wherein the detecting means includes a circuit for electrically detecting the volume of the first fuel within the float chamber, and the valve means is an electromagnetic valve for opening and closing the second passage according to a detection signal from the detecting circuit.

4. A carburetor including an induction passage leading to an engine, in which a first fuel and a second fuel are selectively mixed with air to produce an air-fuel mixture, comprising:

first means for mixing the first fuel with air within the induction passage;

second means for mixing the second fuel with air within the induction passage;

a first passage for feeding the first fuel to the first mixing means;

a second passage for feeding the second fuel to the second mixing means;

float means including a float chamber and a float floating on the first fuel within the float chamber, the first fuel being fed from the first passage into the float chamber;

means for selectively feeding either of the first and second fuels;

means for controlling the feed of the second fuel in response to the liquid level of the first fuel within the float chamber, the controlling means including: means for detecting the liquid level of the first fuel within the float chamber; and a valve for opening the second passage only when the liquid level of the first fuel within the float chamber is below a predetermined value.

5. The carburetor of claim 4, wherein the selectively feeding means includes:

a fuel pump for feeding the first fuel into the first passage;

a valve for regulating the second passage for the second fuel; and switch means for selectively actuating the fuel pump and the valve so that either of the first and second fuels can be fed.

6. The carburetor of claim 4, wherein the detecting means includes a rod fixed at its lower end to the float, the upper end of the rod being connected to the valve in such a way that, when the float moves down to a predetermined level within the float chamber, the valve opens so that the second fuel may be fed into the induction passage.

7. The carburetor of claim 4, wherein the detecting means includes means for electrically detecting the liquid level of the first fuel within the float chamber; and the valve is an electromagnetic valve for opening or closing the second passage according to a signal from the electrically detecting means.

* * * * *